United States Patent [19]

Goldstein et al.

[11] 4,425,168

[45] Jan. 10, 1984

[54] COPPER BERYLLIUM ALLOY AND THE MANUFACTURE THEREOF

[75] Inventors: Sherwood Goldstein, Sinking Spring; Henry T. McClelland, Shoesmakersville; Paul J. Scherbner, Boyertown, all of Pa.

[73] Assignee: Cabot Corporation, Kokomo, Ind.

[21] Appl. No.: 415,205

[22] Filed: Sep. 7, 1982

[51] Int. Cl.[3] ..... C22F 1/08

[52] U.S. Cl. ..... 148/2; 148/12.7 C; 148/160

[58] Field of Search ..... 148/11.5 C, 12.7 C, 148/160; 420/494

[56] References Cited

U.S. PATENT DOCUMENTS 3,658,601 4/1972 Britton et al. ..... 148/12.7 C

*Primary Examiner*—Peter K. Skiff

*Attorney, Agent, or Firm*—Jack Schuman; Robert F. Dropkin

[57] ABSTRACT

A process for producing a copper beryllium alloy. The process includes the steps of: preparing a copper beryllium melt; casting the melt; hot working the cast copper beryllium; annealing the copper beryllium; cold working the annealed copper beryllium; and hardening the copper beryllium; and is characterized by the improvement comprising the steps of: solution annealing the cold worked copper beryllium at a temperature of from 1275° (691°) to 1375° F. (746° C.); hardening the annealed copper beryllium at a temperature of from 400° (204°) to 580° F. (304° C.); cold rolling the hardened copper beryllium; and stress relief annealing the cold worked copper beryllium at a temperature of from 400° (204°) to 700° F. (371° C.).

An alloy consisting essentially of, in weight percent, from 0.4 to 2.5% beryllium, up to 3.5% of material from the group consisting of cobalt and nickel, up to 0.5% of material from the group consisting of titanium and zirconium, up to 0.3% iron, up to 0.7% silicon, up to 0.3% aluminum, up to 1.0% tin, up to 3.0% zinc, up to 1.0% lead, balance essentially copper. The alloy is characterized by equiaxed grains. The grains have an average grain size of less than 9 microns. Substantially all of the grains are less than 12 microns in size.

17 Claims, 3 Drawing Figures

COPPER BERYLLIUM ALLOY AND THE MANUFACTURE THEREOF

The present invention relates to a copper beryllium alloy and to a process for producing the alloy.

Copper beryllium alloys are formed into intricate parts for connector applications. Material for such applications must be both strong and formable.

The trend towards miniaturized connectors has created a need for a copper beryllium alloy of improved formability, with little or no sacrifice in strength. Such an alloy, and a process for producing it, are provided through the present invention.

Two papers which discuss an improved mill hardened copper beryllium alloy for connector applications are entitled, "Improved Mill Hardened Beryllium Copper Strip for Connector Applications" and "Properties of an Advanced Mill Hardened Beryllium Copper Strip for Connector Applications." The first paper was presented at the 13th Annual Connector Symposium 1980. The second paper appeared in a publication entitled the "Electrical Connector Study Group", which was prepared for the 14th Annual Connector Symposium, November 1981. Still other references disclose copper beryllium alloys and/or processing therefor. These references include U.S. Pat. Nos. 1,974,839; 1,975,113; 2,257,708; 2,412,447; 3,138,493; 3,196,006; 3,536,540; 3,753,696; 3,841,922; 3,985,589; and 4,179,314. Although none of the references disclose the subject invention, U.S. Pat. No. 1,974,839 appears to be the most pertinent. It does not, however, disclose a process for improving formability, with little or no sacrifice in strength. It does not disclose the present invention.

It is accordingly an object of the subject invention to provide a copper beryllium alloy and a process for producing the alloy.

The foregoing and other objects of the invention will become apparent from the following detailed description taken in connection with the accompanying figures which form a part of this specification, and in which.

Figure 1:
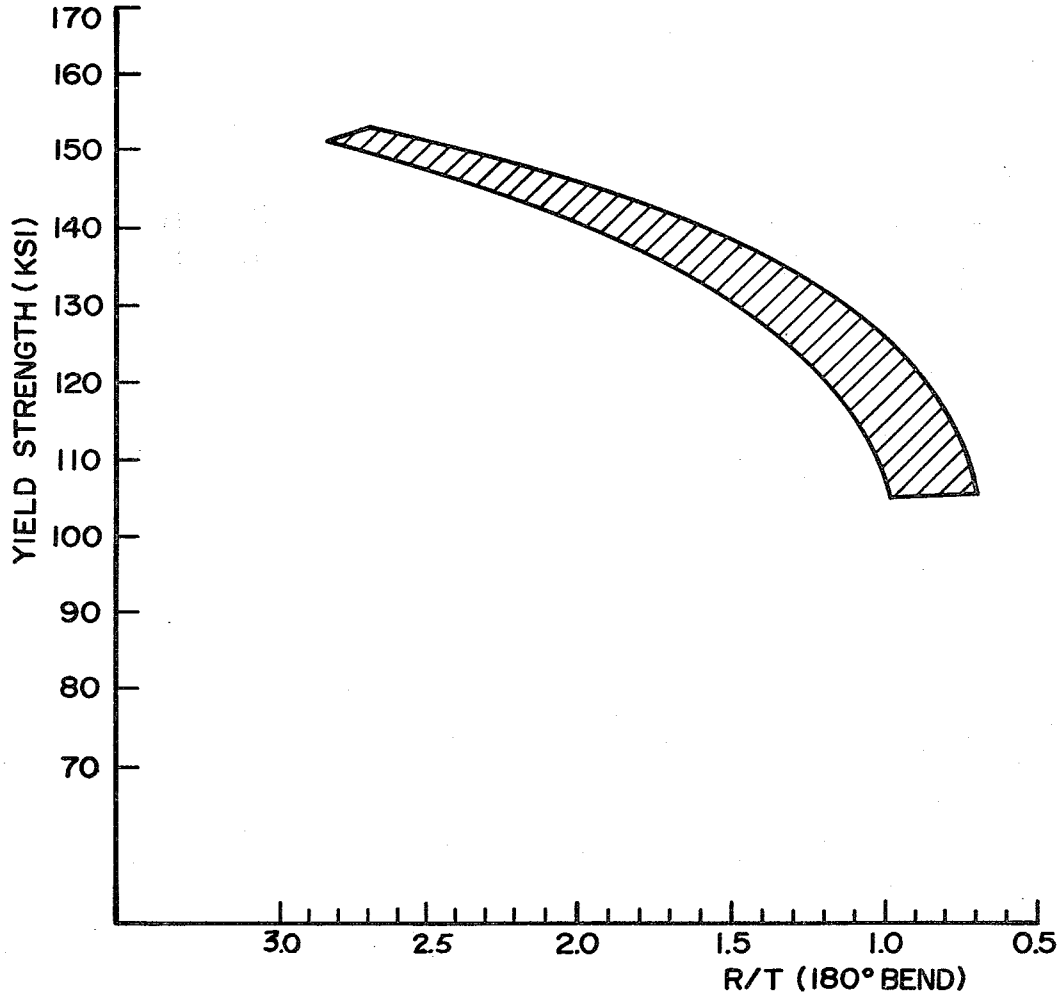
FIG. 1 is a plot of yield strength versus 180° bend radius to thickness (R/T) ratios of samples processed in accordance with the subject invention.

The present invention provides a process for producing a copper beryllium alloy. The process includes the steps of: preparing a copper beryllium melt; casting the melt; hot working the cast copper beryllium; annealing the copper beryllium; cold working the annealed copper beryllium; and hardening the copper beryllium; and is characterized by the improvement comprising the steps of: solution annealing cold worked copper beryllium at a temperature of from 1275° (691°) to 1375° F. (746° C.); hardening the annealed copper beryllium at a temperature of from 400° (204°) to 580° F. (304° C.); cold working the hardened copper beryllium; and stress relief annealing the cold worked copper beryllium at a temperature of from 400° (204°) to 700° F. (371° C.). Hot and cold rolling are, respectively, the usual means of hot and cold working.

The cold worked copper beryllium is solution annealed at a temperature of from 1275° (691°) to 1375° F. (746° C.), and preferably at a temperature of from 1290° (699°) to 1350° F. (732° C.). Solution anneals are conventionally at a higher temperature of from 1450° (788°) to 1480° F. (804° C.). Higher temperatures shorten the period of the anneal and hence increase production rates. Lower temperatures are accompanied by finer grains. Although the reason why the lower temperature of the present invention is beneficial is not shown for sure, it is hypothesized that it contributes to a finer grain and in turn improved formability. Material with finer grains is also less susceptible to the formation of orange peel surface. Time at temperature cannot be set forth in a definite fashion as it is dependent on several well-known factors. It is generally less than twelve minutes and usually less than five minutes.

The annealed copper beryllium is hardened (underaged) at a temperature of from 400° (204°) to 580° F. (304° C.), and preferably at a temperature of from 450° (232°) to 510° F. (266° C.), to aid in the development of the desired mechanical properties. Hardening is done at a temperature of 580° F. (304° C.) or lower as undesirable precipitates are believed to form at higher temperatures. Time at temperature cannot be set forth in a definite fashion as it is dependent on several well-known factors. It is generally more than two hours and usually more than three hours.

The hardened material is cold worked to increase its strength. Cold working is generally to final gauge. It generally results in a reduction in thickness of at least 3%. The reduction is usually at least 10%.

The cold worked material is stress relief annealed at a temperature of from 400° (204°) to 700° F. (371° C.). The temperature of the stress relief anneal is generally from 500° (260°) to 650° F. (343° C.) and usually from 580° (304°) to 620° F. (327° C.). Stress relief annealing improves the formability of the cold worked material without such sacrifice in strength. Time at temperature cannot be set forth in a definite fashion as it is dependent on several well-known factors. It is generally less than seven minutes and usually less than five minutes.

The steps prior to the characterization part of the invention are not discussed in detail. They are well known to those skilled in the art and are disclosed in many references including those cited herein.

The process may, and preferably should, include an overaging heat treatment at an intermediate cold working gauge. This treatment is prior to the solution anneal at a temperature of from 1275° (691°) to 1375° F. (746° C.). It is generally at a temperature of at least 900° F. (482° C.) for a period of at least six hours, and usually at a temperature of at least 1000° F. (538° C.) for a period of at least eight hours.

The process of the subject invention is believed to be adaptable to the manufacture of any number of copper beryllium alloys. These alloys will generally contain from 0.4 to 2.5% beryllium, up to 3.5% of material from the group consisting of cobalt and nickel, up to 0.5% of material from the group consisting of titanium and zirconium, and at least 90% copper.

The alloy of the present invention consists essentially of, in weight percent, from 0.4 to 2.5% beryllium, up to 3.5% of material from the group consisting of cobalt and nickel, up to 0.5% of material from the group consisting of titanium and zirconium, up to 0.3% iron, up to 0.7% silicon, up to 0.3% aluminum, up to 1.0% tin, up to 3.0% zinc, up to 1.0% lead, balance essentially copper. The processed alloy is characterized by equiaxed grains. The grains have an average grain size of less than 9 microns. Substantially (85% or more) all of the grains are less than 12 microns in size. A preferred structure has an average grain size of less than 7 microns with substantially (85% or more) all of the grains being less than 10 microns. The beryllium content of the alloy is usually between 1.5 and 2.0%. Grain boundary precipitates, which are believed to be undesirable, are usually limited to amounts of less than 1%. The alloy can also be characterized as having a yield strength and a 180° bend radius to thickness ratio within the cross-hatched area of FIG. 1. FIG. 1 is discussed hereinbelow. Grain size determinations are in accordance with ASTM Designation: E 112-81.

The following examples are illustrative of several aspects of the invention.

EXAMPLE I

Copper beryllium was melted, cast, hot rolled to a gauge of approximately 0.3 inch (7.62 mm), annealed at a temperature of approximately 1470° F. (799° C.) for approximately 3 hours, cold rolled to a gauge of approximately 0.09 inch (2.29 mm), strand annealed at a temperature of approximately 1475° F. (802° C.), cold rolled to a gauge of approximately 0.025 inch (0.635 mm) with intermediate strand anneals at a temperature of approximately 1475° F. (802° C.), heat treated at 1050° F. (566° C.) for 10 hours, cold rolled to a gauge of approximately 0.0094 inch (0.239 mm), strand annealed at 1300° F. (704° C.), underaged as described hereinbelow, cold rolled as described hereinbelow and stress relief annealed at 600° F. (316° C.) for 2 minutes in a salt bath. The 1300° F. (704° C.) strand anneal took place in a furnace having a hot zone of approximately 20 feet (6.1 m) at a speed of 5.3 feet (1.62 m) per minute. Underaging occurred at three different temperatures [470 (243), 480 (249) and 490° F. (254° C.)] for three different time periods [4, 5 and 6 hours]. Cold rolling was to three different aim gauges [0.0084 (0.213), 0.0078 (0.198) and 0.0076 inch (0.193 mm)]. The underaging variables (temperature and time) produced 9 sets of samples. The cold rolling variable (gauge) increased the number of sets of samples to 27.

The chemistry of the cold rolled copper beryllium strip is set forth hereinbelow in Table I.

TABLE I

| Element | Wt. % |
|---|---|
| Be | 1.91 |
| Fe | 0.10 |
| Si | 0.14 |
| Al | 0.03 |
| Co | 0.28 |
| Sn | 0.03 |
| Pb | 0.001 |
| Zn | <0.01 |
| Ni | 0.04 |
| Cr | 0.005 |
| Mn | 0.005 |
| Ag | 0.01 |

Underaged samples were tested parallel to the rolling direction for ultimate tensile strength, 0.2% yield strength and elongation. These samples were not cold rolled to final gauge. The results of the tests appear hereinbelow in Table II.

TABLE II

| Aging Temperature | | Aging Time | UTS* | | YS* | | Elongation* |
|---|---|---|---|---|---|---|---|
| (°F.) | (°C.) | (hours) | (ksi) | (MPa) | (ksi) | (MPa) | (%) |
| 470 | 243 | 4 | 97.3 | 670.9 | 72.0 | 496.4 | 21.8 |

TABLE II-continued

| Aging Temperature | | Aging Time | UTS* | | YS* | | Elongation* |
|---|---|---|---|---|---|---|---|
| (°F.) | (°C.) | (hours) | (ksi) | (MPa) | (ksi) | (MPa) | (%) |
| 470 | 243 | 5 | 105.3 | 726.0 | 78.2 | 539.2 | 22.8 |
| 470 | 243 | 6 | 106.7 | 735.7 | 83.4 | 575.0 | 16.0 |
| 480 | 249 | 4 | 103.4 | 712.9 | 79.5 | 548.1 | 16.0 |
| 480 | 249 | 5 | 112.8 | 777.7 | 88.0 | 606.7 | 14.0 |
| 480 | 249 | 6 | 116.5 | 803.2 | 94.7 | 652.9 | 10.8 |
| 490 | 254 | 4 | 120.0 | 827.4 | 91.5 | 630.9 | 20.0 |
| 490 | 254 | 5 | 120.8 | 832.9 | 98.8 | 681.2 | 10.0 |
| 490 | 254 | 6 | 131.9 | 909.4 | 103.8 | 715.7 | 18.0 |

*Average of two values with the exception of elongation after underaging at 490° F. for 6 hours.

Samples which were underaged and cold rolled to final gauge were tested for ultimate tensile strength, 0.2% yield strength and elongation. The samples are identified hereinbelow in Table III. The results of the tests appear hereinbelow in Table IV.

TABLE III

| Sample No. | Aging Temperature (°F.) | Aging Temperature (°C.) | Aging Time (Hours) | Cold Rolling* (% Reduction) |
|---|---|---|---|---|
| A | 470 | 243 | 4 | 13.3 |
| B | 470 | 243 | 4 | 19.7 |
| C | 470 | 243 | 4 | 22.6 |
| D | 470 | 243 | 5 | 13.3 |
| E | 470 | 243 | 5 | 20.0 |
| F | 470 | 243 | 5 | 21.6 |
| G | 470 | 243 | 6 | 12.0 |
| H | 470 | 243 | 6 | 20.2 |
| I | 470 | 243 | 6 | 21.8 |
| J | 480 | 249 | 4 | 12.3 |
| K | 480 | 249 | 4 | 18.7 |
| L | 480 | 249 | 4 | 20.9 |
| M | 480 | 249 | 5 | 11.2 |
| N | 480 | 249 | 5 | 20.7 |
| O | 480 | 249 | 5 | 21.7 |
| P | 480 | 249 | 6 | 12.1 |
| Q | 480 | 249 | 6 | 17.0 |
| R | 480 | 249 | 6 | 19.7 |
| S | 490 | 254 | 4 | 11.3 |
| T | 490 | 254 | 4 | 19.3 |
| U | 490 | 254 | 4 | 19.8 |
| V | 490 | 254 | 5 | 11.0 |
| W | 490 | 254 | 5 | 16.9 |
| X | 490 | 254 | 5 | 19.8 |
| Y | 490 | 254 | 6 | 12.2 |
| Z | 490 | 254 | 6 | 19.6 |
| AA | 490 | 254 | 6 | 20.9 |

*Average of two values.

TABLE IV

| Sample No. | UTS* (ksi) | UTS* (MPa) | YS* (ksi) | YS* (MPa) | Elongation* (%) |
|---|---|---|---|---|---|
| A | 116.6 | 803.9 | 110.8 | 763.9 | 14.3 |
| B | 127.6 | 879.8 | 122 | 841.2 | 5.3 |
| C | 131.5 | 906.7 | 125.9 | 868.0 | 3.0 |
| D | 122.6 | 845.3 | 116.6 | 803.9 | 13.8 |
| E | 135.5 | 934.2 | 128.4 | 885.3 | 5.5 |
| F | 138.9 | 957.7 | 131.1 | 903.9 | 4.0 |
| G | 130.5 | 899.8 | 124.2 | 856.3 | 11.0 |
| H | 139.8 | 963.9 | 133.1 | 917.7 | 4.5 |
| I | 142.7 | 983.9 | 135.4 | 933.6 | 3.5 |
| J | 128.7 | 887.4 | 121.6 | 838.4 | 12.8 |
| K | 140.6 | 969.4 | 134.0 | 923.9 | 5.8 |
| L | 144.2 | 994.2 | 136.2 | 939.1 | 3.8 |
| M | 133.2 | 918.4 | 123.7 | 852.9 | 13.5 |
| N | 144.4 | 995.6 | 137.1 | 945.3 | 3.5 |
| O | 148.0 | 1020.4 | 140.1 | 966.0 | 3.3 |
| P | 143.5 | 989.4 | 135.2 | 932.2 | 9.5 |
| Q | 152.9 | 1054.2 | 144.1 | 993.5 | 4.3 |
| R | 154.3 | 1063.9 | 145.2 | 1001.1 | 4.0 |
| S | 139.2 | 959.8 | 128.2 | 883.9 | 7.3 |
| T | 151.7 | 1045.9 | 142.1 | 979.7 | 4.5 |

TABLE IV-continued

| Sample No. | UTS* (ksi) | UTS* (MPa) | YS* (ksi) | YS* (MPa) | Elongation* (%) |
|---|---|---|---|---|---|
| U | 152.0 | 1048 | 143.7 | 990.8 | 4.0 |
| V | 150.2 | 1035.6 | 140.2 | 966.0 | 8.0 |
| W | 158.1 | 1090.1 | 147.3 | 1015.6 | 3.3 |
| X | 159.3 | 1098.3 | 148.0 | 1020.4 | 1.5 |
| Y | 154.0 | 1061.8 | 142.9 | 985.3 | 7.5 |
| Z | 163.4 | 1126.6 | 151.4 | 1043.9 | 4.0 |
| AA | 164.3 | 1132.8 | 151.3 | 1043.2 | 3.0 |

*Average of two values.

Samples which were underaged, cold rolled to final gauge and stress relief annealed were tested for ultimate tensile strength, 0.2% yield strength, elongation and 180° bend radius to thickness (R/T) ratios. The samples are identified hereinbelow in Table V. The results of the tests appear hereinbelow in Table VI. The R/T values in Table VI are the best of several tests. Samples were bent through 180° and to a specified inside radius of curvature. The samples were supported near their ends on rounded shoulders of the test fixture. A load was applied through a mandrel midway between the two supports. In the criterion for failure is the occurrence of cracks found on the tension surface of the specimen after bending.

TABLE V

| Sample No. | Aging Temperature (°F.) | Aging Temperature (°C.) | Aging Time (Hour) | Cold* Rolling (% Reduction) |
|---|---|---|---|---|
| A' | 470 | 243 | 4 | 12.2 |
| B' | 470 | 243 | 4 | 20.0 |
| C' | 470 | 243 | 4 | 22.1 |
| D' | 470 | 243 | 5 | 13.5 |
| F' | 470 | 243 | 5 | 20.4 |
| G' | 470 | 243 | 6 | 12.5 |
| H' | 470 | 243 | 6 | 18.5 |
| I' | 470 | 243 | 6 | 20.9 |
| J' | 480 | 249 | 4 | 12.1 |
| K' | 480 | 249 | 4 | 20.4 |
| L' | 480 | 249 | 4 | 19.6 |
| M' | 480 | 249 | 5 | 11.4 |
| N' | 480 | 249 | 5 | 19.3 |
| O' | 480 | 249 | 5 | 20.7 |
| P' | 480 | 249 | 6 | 10.8 |
| Q' | 480 | 249 | 6 | 19.4 |
| R' | 480 | 249 | 6 | 19.1 |
| S' | 490 | 254 | 4 | 12.1 |
| T' | 490 | 254 | 4 | 17.4 |
| U' | 490 | 254 | 4 | 19.6 |
| V' | 490 | 254 | 5 | 10.7 |
| W' | 490 | 254 | 5 | 18.2 |
| X' | 490 | 254 | 5 | 19.3 |
| Y' | 490 | 254 | 6 | 13.0 |
| Z' | 490 | 254 | 6 | 19.3 |
| AA' | 490 | 254 | 6 | 20.9 |

*Average of two values with the exception of sample F' which is the average of three values.

TABLE VI

| Sample No. | UTS* (ksi) | UTS* (MPa) | YS* (ksi) | YS* (Mpa) | Elongation* (%) | R/T |
|---|---|---|---|---|---|---|
| A' | 118.5 | 817.0 | 104.4 | 719.8 | 19 | 0.72 |
| B' | 127.0 | 875.6 | 115.7 | 797.7 | 16.3 | 0.80 |
| C' | 128.8 | 888.0 | 118.3 | 815.6 | 15.0 | 0.81 |
| D' | 125.1 | 862.5 | 111.0 | 765.3 | 13.5 | 1.0 |
| F' | 134.2 | 925.3 | 124.0 | 854.9 | 13.2 | 1.3 |
| G' | 131.3 | 905.3 | 119.0 | 820.5 | 15.5 | 1.20 |
| H' | 139.5 | 961.8 | 129.1 | 890.1 | 14.3 | 1.56 |
| I' | 141.7 | 977.0 | 132.8 | 915.6 | 12.8 | 1.60 |
| J' | 130.3 | 898.4 | 117.3 | 808.8 | 17.0 | 1.20 |
| K' | 136.5 | 941.1 | 126.5 | 872.2 | 14.5 | 1.57 |
| L' | 137.4 | 947.3 | 127.9 | 881.8 | 13.3 | 1.56 |
| M' | 134.2 | 925.3 | 121.4 | 837.0 | 17.0 | 1.20 |

TABLE VI-continued

| Sample No. | UTS* (ksi) | UTS* (MPa) | YS* (ksi) | YS* (Mpa) | Elongation* (%) | R/T |
|---|---|---|---|---|---|---|
| N' | 143.5 | 989.4 | 134.3 | 926.0 | 12.5 | 1.57 |
| O' | 145.3 | 1001.8 | 136.5 | 941.1 | 11.3 | 1.60 |
| P' | 142.5 | 982.5 | 130.6 | 900.5 | 14.8 | 1.44 |
| Q' | 143.9 | 992.2 | 134.3 | 926.0 | 13.3 | 1.87 |
| R' | 149.7 | 1032.1 | 141.3 | 974.2 | 11.0 | 1.86 |
| S' | 138.4 | 954.2 | 129.4 | 892.2 | 9.0 | 1.45 |
| T' | 148.6 | 1024.6 | 140.0 | 965.3 | 11.3 | 1.80 |
| U' | 149.4 | 1030.1 | 141.4 | 974.9 | 8.0 | 1.85 |
| V' | 146.7 | 1011.5 | 135.8 | 936.3 | 13.8 | 1.44 |
| W' | 155.0 | 1068.7 | 146.0 | 1006.6 | 9.5 | 2.10 |
| X' | 154.7 | 1066.6 | 146.8 | 1012.2 | 7.5 | 2.10 |
| Y' | 151.2 | 1042.5 | 141.6 | 976.3 | 11.8 | 1.70 |
| Z' | 159.3 | 1098.3 | 149.5 | 1030.8 | 8.0 | 2.40 |
| AA' | 159.2 | 1047.6 | 150.7 | 1039.0 | 7.0 | 2.40 |

*Average of two values with the exception of sample F' which is the average of three values.

A plot of yield strength versus R/T values for Samples A' through AA', with the exception of Samples H, J, K, L and Q, produced the cross-hatched area of FIG. 1. The cross-hatched area represents a range of yield strengths one might expect to obtain for a particular R/T value, or conversely a range of R/T values one might expect to obtain for a particular yield strength, when material is processed in accordance with the present invention. The cross-hatched area represents a combination of properties which compare very favorably with typical properties exhibited heretofore. They show lower R/T values for the same yield strength and conversely higher yield strengths for the same R/T value.

A comparison of Tables II, IV and VI shows how cold working significantly improves the strength of the underaged material and how stress relief annealing significantly improves the formability of the cold worked material without much sacrifice in strength. The present invention employs an underaging treatment, cold working of the aged material and a stress relief anneal.

Figure 2:
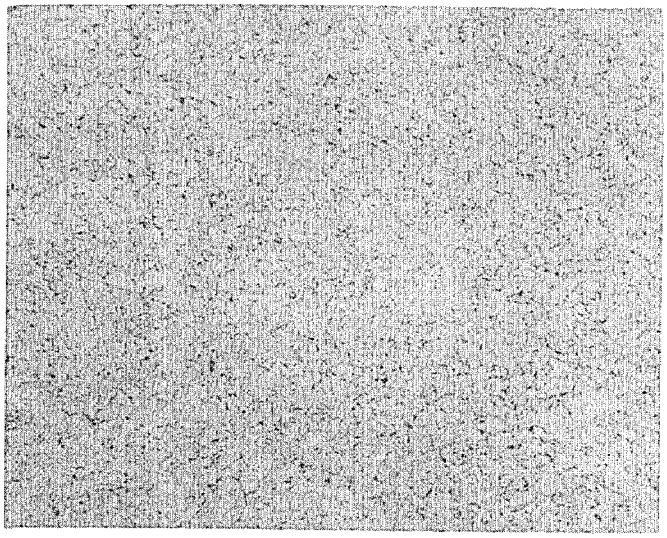
FIG. 2 is a photomicrograph at 500X of a sample after it was hardened at 490° F. (254° C.) for 6 hours.

A photomicrograph, taken at 500X, of material hardened at 490° F. (254° C.) for 6 hours appears as FIG. 2. The material is characterized by equiaxed grains. The average grain size of the material is 6 microns. Substantially (85% or more) all of the grains are less than 10 microns in size. Grain boundary precipitates are less than 1%. Grain size measurements are in accordance with ASTM Designation: E 112-81.

EXAMPLE II

Copper beryllium was melted, cast, hot rolled to a gauge of approximately 0.3 inch, annealed at a temperature of approximately 1470° F. (799° C.) for approximately 3 hours, cold rolled to a gauge of approximately 0.09 (2.29 mm) inch, strand annealed at a temperature of approximately 1475° F. (802° C.), cold rolled to a gauge of approximately 0.045 inch (1.14 mm), with an intermediate strand anneal at a temperature of approximately 1475° F. (802° C.), heat treated at 1050° F. (566° C.) for 10 hours, cold rolled to a gauge of approximately 0.016 inch (0.41 mm), strand annealed at 1300° F. ((704° C.), underaged at 470° F. (243° C.) for 5.5 hours, cold rolled to a gauge of 0.014 inch (0.356 mm) and stress relief annealed at 600° F. (316° C.). The 1300° F. (704° C.) strand anneal took place in a furnace with a hot zone of approximately 20 feet (6.1 m) at a speed of 5.3 feet (1.62 m) per minute. The 600° F. (316° C.) stress relief anneal took place in a 40-foot (12.2 m) furnace at a speed of 9.6 feet (2.93 m) per minute.

The chemistry of the cold rolled copper beryllium strip is set forth hereinbelow in Table VII.

TABLE VII

| Element | WT. %* |
|---|---|
| Be | 1.94 |
| Fe | 0.10 |
| Si | 0.14 |
| Al | 0.05 |
| Co | 0.22 |
| Sn | 0.03 |
| Pb | 0.002 |
| Zn | 0.03 |
| Ni | 0.06 |
| Cr | 0.005 |
| Mn | 0.010 |
| Ag | 0.01 |

*Average of two analysis

Samples were tested for ultimate tensile strength, 0.2% yield strength and elongation. The results of the tests appear hereinbelow in Table VIII.

TABLE VIII

| UTS* | | Y.S.* | | Elongation* |
|---|---|---|---|---|
| (ksi) | (MPa) | (kis) | (MPa) | % |
| 129.8 | 894.9 | 117.3 | 808.8 | 17.7 |

*Average of multiple samples from both ends of a coil

Samples were also tested for 180° bend radius to thickness (R/T) ratios as were the samples of Example 1. The results were most impressive. Eighty-five percent of the tested samples had an R/T value of approximately one. Over eighty-five percent of the tested samples fell within the cross-hatched area of FIG. 1.

Figure 3:
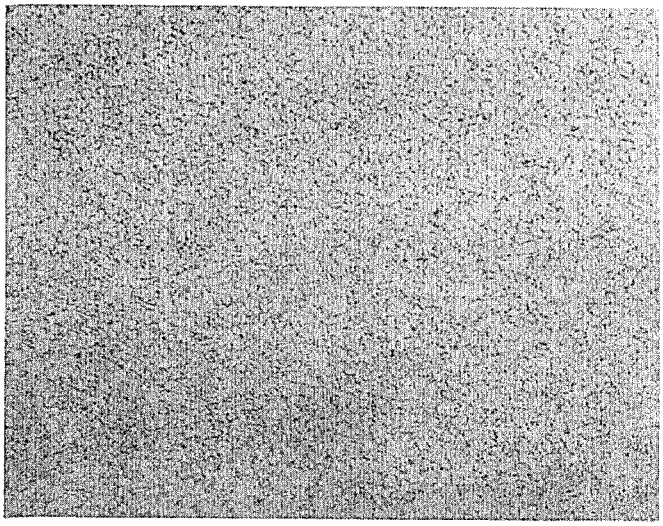
FIG. 3 is a photomicrograph at 500X of a sample after it was stress relief annealed at 600° F. (316° C.).

A photomicrograph, taken at 500X, of a stress relief annealed sample appears as FIG. 3. The material is characterized by equiaxed grains. The average grain size of the material is 6 microns. Substantially (85% or more) all of the grains are less than 10 microns in size. Grain boundary precipitates are less than 1%. Grain size measurements are in accordance with ASTM Designation: E 112-81.

It will be apparent to those skilled in the art that the novel principles of the invention disclosed herein in connection with specific examples thereof will suggest various other modifications and applications of the same. It is accordingly desired that in contruing the breadth of the appended claims they shall not be limited to the specific examples of the invention described herein.

We claim:

1. In a process for producing a copper beryllium alloy having a desirable combination of strength and formability characterized by a yield strength and a 180° bend radius to thickness ratio within, directly to the right or directly above the cross-hatched area of FIG. 1, which process includes the steps of: preparing a copper beryllium melt; casting the melt; hot working the cast copper beryllium; annealing the copper beryllium; cold working the annealed copper beryllium; and hardening the copper beryllium; the improvement comprising the steps of: solution annealing cold worked copper beryllium at a temperature of from 1275° (691°) to 1375° F. (746° C.); hardening said annealed copper beryllium at a temperature of from 400° (204°) to 580° F. (304° C.); cold working said hardened copper beryllium, said cold working resulting in a reduction in thickness of at least 3%; and stress relief annealing said cold worked copper beryllium at a temperature of from 400° (204°) to 700° F. (371° C.).

2. The process according to claim 1, wherein said cold worked copper beryllium is solution annealed at a temperature of from 1290° (699°) to 1350° F. (732° C.).

3. The process according to claim 1, wherein said solution anneal at a temperature of from 1275° (691°) to 1375° F. (746° C.) is for a period of less than twelve minutes.

4. The process according to claim 3, wherein said solution anneal at a temperature of from 1275° (691°) to 1375° F. (746° C.) is for a period of less than five minutes.

5. The process according to claim 1, wherein said annealed copper beryllium is hardened at a temperature of from 450° (232°) to 510° F. (266° C.).

6. The process according to claim 1, wherein said hardening at a temperature of from 400° (204°) to 580° F. (304°) is for a period of at least two hours.

7. The process according to claim 6, wherein said hardening at a temperature of from 400° (204°) to 580° F. (304° C.) is for a period of at least three hours.

8. The process according to claim 1, wherein said aged copper beryllium is cold worked to final gauge.

9. The process according to claim 1, wherein the copper beryllium alloy has a yield strength and a 180° bend radius to thickness ratio within the cross-hatched area of FIG. 1.

10. The process according to claim 1 wherein said cold working results in a reduction in thickness of at least 10%.

11. The process according to claim 1, wherein said cold worked copper beryllium is stress relief annealed at a temperature of from 500° (260°) to 650° F. (343° C.).

12. The process according to claim 11, wherein said cold worked copper beryllium is stress relief annealed at a temperature of from 580° (304°) to 620° F. (326° C.).

13. The process according to claim 1, wherein said stress relief anneal at a temperature of from 400° (204°) to 700° F. (371° C.) is for a period of less than seven minutes.

14. The process according to claim 13, wherein said stress relief anneal at a temperature of from 400° (204°) to 700° F. (371° C.) is for a period of less than five minutes.

15. The process according to claim 1, including the step of heat treating the copper beryllium, at an intermediate cold working gauge and prior to said solution anneal at a temperature of from 1275° (691°) to 1375° F. (746° C.), at a temperature of at least 900° F. (482° C.) for a period of at least six hours.

16. The process according to claim 15, wherein the copper beryllium is heat treated at an intermediate cold working gauge and prior to said solution anneal at a temperature of from 1275° (691°) to 1375° F. (746° C.), at a temperature of at least 1000° F. (538° C.) for a period of at least eight hours.

17. A copper beryllium alloy having, in weight percent, from 0.4 to 2.5% beryllium, up to 3.5% of material from the groups consisting of cobalt and nickel, up to 0.5% of material from the groups consisting of titanium and zirconium, and at least 90% copper and made in accordance with the process of claim 1.

* * * * *